United States Patent [19]

Takebe

[11] Patent Number: 4,890,139

[45] Date of Patent: Dec. 26, 1989

[54] IMAGE FORMING APPARATUS

[75] Inventor: Kaoru Takebe, Osaka, Japan

[73] Assignee: Minolta Camera Kabushiki Kaisha, Osaka, Japan

[21] Appl. No.: 267,296

[22] Filed: Nov. 4, 1988

[30] Foreign Application Priority Data

Nov. 7, 1987 [JP] Japan ..... 62-281357

[51] Int. Cl.[4] ..... G03G 21/00

[52] U.S. Cl. ..... 355/268; 355/244; 355/326

[58] Field of Search ..... 355/268, 267, 244, 245, 355/210, 311, 326; 430/100

[56] References Cited

U.S. PATENT DOCUMENTS

| | | | |
|---|---|---|---|
| 3,674,354 | 7/1972 | Artaud et al. | 355/268 X |
| 3,992,089 | 11/1976 | Hirose et al. | 355/268 X |
| 4,579,443 | 4/1986 | Abuyama et al. . | |
| 4,582,417 | 4/1986 | Yagasaki et al. . | |
| 4,659,211 | 4/1987 | Oka | 355/268 |
| 4,678,314 | 7/1987 | Uchida et al. | 355/268 X |
| 4,769,675 | 9/1988 | Watanabe | 355/328 X |
| 4,789,878 | 12/1988 | Endo et al. | 355/268 X |
| 4,806,974 | 2/1989 | Shimazaki | 355/268 X |

FOREIGN PATENT DOCUMENTS

| | | |
|---|---|---|
| 950767 | 7/1974 | Canada . |
| 61-256357 | 11/1986 | Japan . |

*Primary Examiner*—R. L. Moses

*Attorney, Agent, or Firm*—Burns, Doane, Swecker & Mathis

[57] ABSTRACT

An image forming apparatus capable of producing both a normal image and a reversal image, is provided with a photosensitive member, a charger for charging the photosensitive member, an optical system for forming an electrostatic latent image on the photosensitive member, a first developing device for developing the electrostatic latent image using black toner, a second developing device for developing the electrostatic latent image using white toner, a white paper supply cassette for supplying a white paper into a transfer region confronting the photosensitive member, a black paper supply cassette for supplying a black paper into the transfer region, and a control system including a microcomputer for controlling the developing devices and the paper supply cassettes to form a black toner image on the white paper or a white toner image on the black paper.

11 Claims, 8 Drawing Sheets

IMAGE FORMING APPARATUS

BACKGROUND OF THE INVENTION

1. Field of the Invention

The present invention relates to an image forming apparatus which is capable of producing not only a normal image but a reversal image.

2. Description of the Prior Art

In some of conventional image forming apparatuses having an electrophotographic reproducing process, there are provided a normal image producing mode for producing a positive image from a positive original or a positive film and a reversal image producing mode for producing a positive image from a negative original or a negative film. The image forming apparatuses of this kind employ therein either of the following image forming methods to carry out these two image producing modes.

One of such image forming methods requires an electrostatic latent image support member which is sensitive to both positive and negative polarity and two electrifying chargers disposed in the vicinity of the electrostatic latent image support member for charging the surface of the electrostatic latent image support member in the positive and negative polarity, respectively. In this method, the electrostatic latent image support member is initially charged in either positive or negative polarity in accordance with the selected image producing mode. Identical toner is then supplied to either an electric charge holding portion or an electric charge erased portion of the electrostatic latent image formed on the support member.

Another image forming method requires an electrostatic latent image support member which is sensitive only to either the positive polarity or the negative polarity, a developing device having therein toner of the positive polarity, another developing device having therein toner of the negative polarity and two transfer chargers having respective discharging characteristics in different polarity. In this method, toner of the positive or negative polarity is supplied onto the surface of the electrostatic latent image support member in accordance with the selected image producing mode. Furthermore, either one of the transfer chargers is selectively used in accordance with the polarity of the supplied toner.

However, a multi-color image forming apparatus having a plurality of developing devices is provided in its limited space along the periphery of the electrostatic latent image support member with various devices required for executing the electrophotographic reproducing process. Accordingly, the apparatus does not have enough space for the two transfer chargers or electrifying chargers. This is particularly conspicuous in a small-sized copying apparatus, printer and multi-color copying apparatus.

Furthermore, in the image forming method of the former, it is necessary to switch the polarity of developing bias voltage which is applied to a developing sleeve accommodated in a developing device, rendering a power device to become undesirably large.

In the method of the latter, because the two developing devices accommodate respective toners which are different from each other in polarity, an image produced is occasionally subjected to fog due to the toner supplied from the developing device not in use.

SUMMARY OF THE INVENTION

Accordingly, the present invention has been developed with a view to substantially eliminating the above described disadvantages inherent in the prior art image forming apparatus, and has for its essential object to provide an improved image forming apparatus which is capable of producing not only a normal image but a reversal image by making use of white toner without the necessity of providing two transfer or electrifying chargers. This is based on the fact that the white toner has recently been developed in addition to black or any other colored toner.

Another important object of the present invention is to provide an image forming apparatus which is simple in construction and stable in functioning, and can be readily manufactured at a low cost.

In accomplishing these and other objects, the image forming apparatus according to the present invention is provided with a photosensitive member, a means for charging the photosensitive member, a means for forming an electrostatic latent image on the photosensitive member, a first developing means for developing the electrostatic latent image using a first toner, a second developing means for developing the electrostatic latent image using a second toner which is different in color from the first toner, a first paper supply means for supplying a first paper which is the same in color as the second toner into a transfer region confronting the photosensitive member, a second paper supply means for supplying a second paper which is the same in color as the first toner into the transfer region, a first control means for controlling the first developing means and the first paper supply means in order to form a first toner image on the first paper, a second control means for controlling the second developing means and the second paper supply means in order to form a second toner image on the second paper, and a means for selecting either one of the first and second control means.

In another aspect of the present invention, the image forming apparatus is provided with a photosensitive member, a means for charging the photosensitive member, a means for forming an electrostatic latent image corresponding to an original image on the photosensitive member, a first developing means for developing the electrostatic latent image using a first toner, a second developing means for developing the electrostatic latent image using a second toner which is different in color from the first toner, a first paper supply means for supplying a first paper which is the same in color as the second toner into a transfer region confronting the photosensitive member, a second paper supply means for supplying a second paper which is the same in color as the first toner into the transfer region, a selecting means for selecting either one of a first image producing mode for producing a positive image from a positive original document and a second image producing mode for producing a positive image from a negative original document, and a controlling means for selecting the first developing means and the first paper supply means so that a first toner image may be formed on the first paper when the first image producing mode has been selected by the selecting means and for selecting the second developing means and the second paper supply means so that a second toner image may be formed on the second paper when the second image producing mode has been selected by the selecting means.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by numerals, and wherein.

DETAILED DESCRIPTION OF THE PREFERRED EMBODIMENT

Figure 1:
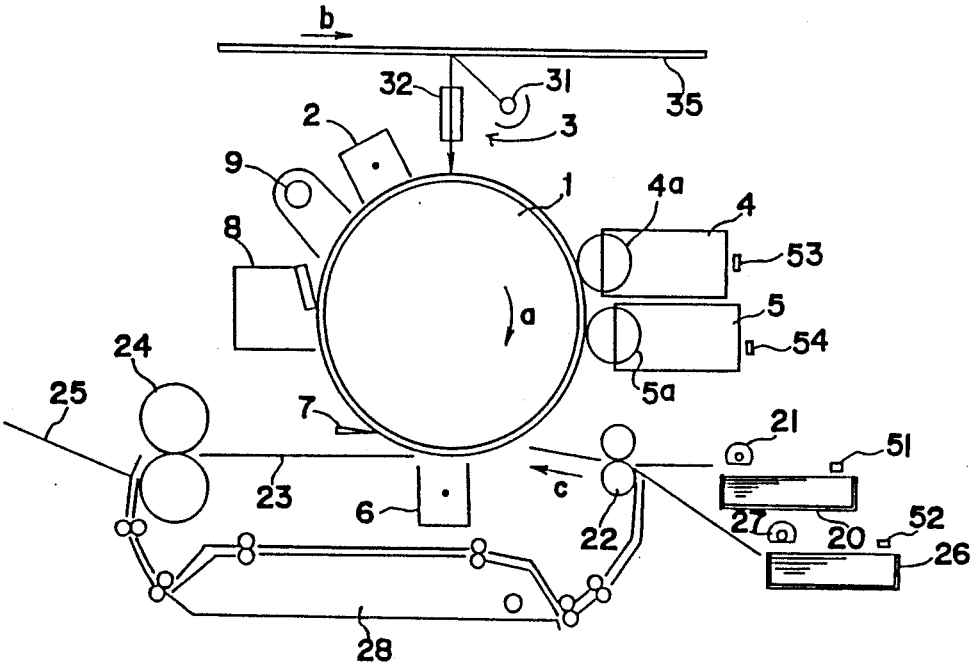
FIG. 1 is a schematic elevational view of a multicolor copying apparatus according to the present invention.

FIG. 1 depicts a multi-color copying apparatus according to one preferred embodiment of the present invention, which is equipped with a movable document platform.

The apparatus of FIG. 1 is internally provided substantially at its central portion with a photosensitive drum 1 as an electrostatic latent image support member. Along the periphery of the photosensitive drum 1 are disposed a main charger 2, an optical system 3, a first developing device 4, a second developing device 5, a transfer charger 6, a separating claw piece 7, a cleaning device 8 and an eraser lamp 9 in this order in a direction of rotation of the photosensitive drum 1.

The first and second developing devices 4 and 5 are detachably mounted in the apparatus on one side of the photosensitive drum 1 and are provided with respective developing sleeves 4*a* and 5*a* confronting the photosensitive drum 1. A fixed developing bias voltage (not shown) is applied to these developing sleeves 4*a* and 5*a*. Both the developing devices 4 and 5 accommodate two-component developer of toner and carrier. More specifically, the first developing device 4 accommodates white toner and carrier whereas the second developing device 5 accommodates black toner and carrier. The white toner and the black toner are mixed and agitated with the carrier in the first and second developing devices 4 and 5, respectively, and charged in polarity opposite to the polarity of the charged photosensitive drum 1. Furthermore, two toner color detecting sensors 53 and 54 for detecting the color of toner accommodated in the developing devices 4 and 5 are disposed on these devices 4 and 5 on the side opposite to the developing sleeves 4*a* and 5*a*.

A paper supply system, a paper transport system and a paper refeed device 28 are disposed at a lower portion of the copying apparatus. The paper supply system is comprised of two paper supply cassettes 20 and 26 detachably mounted in the apparatus and two paper supply rollers 21 and 27 disposed above respective paper supply cassettes 20 and 26. The paper transport system is comprised of a pair of transport rollers 22 for transporting copy papers supplied from the paper supply cassettes 20 and 26, a guide plate 23 for guiding each of the copy papers onto which toner images have been transferred, a pair of fixing rollers 24 for fixing the toner images formed on the copy papers and a paper discharge tray 25 onto which the copy papers having thereon the toner images are discharged. The paper supply cassettes 20 and 26 accommodate white copy papers in general use or black ones. Furthermore, in the vicinity of the paper supply cassettes 20 and 26 are disposed respective paper color detecting sensors 51 and 52 for detecting the color of papers accommodated in these cassettes 20 and 26.

Figure 2:
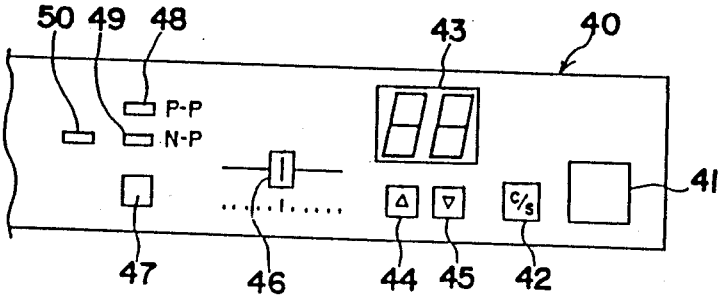
FIG. 2 is a fragmentary top plan view of an operation panel.

FIG. 2 depicts part of an operation panel 40 mounted on an upper portion of the apparatus body. As shown in FIG. 2, the operation panel 40 is provided with a print switch 41, a CLEAR-STOP key 42, a display portion 43 for displaying the number of copies or the like, a pair of UP and DOWN keys 44 and 45, a density regulating lever 46 for regulating image density, a mode selecting key 47 for switching an image producing mode of the copying apparatus to either a normal mode or a reversal mode, LEDs 48 and 49 for respectively indicating that the normal image producing mode has been selected and that the reversal image producing mode has been selected, and another LED 50 for informing of the absence of the black paper in both the paper supply cassettes 20 and 26 when the reversal image producing mode has been selected.

Figure 3:
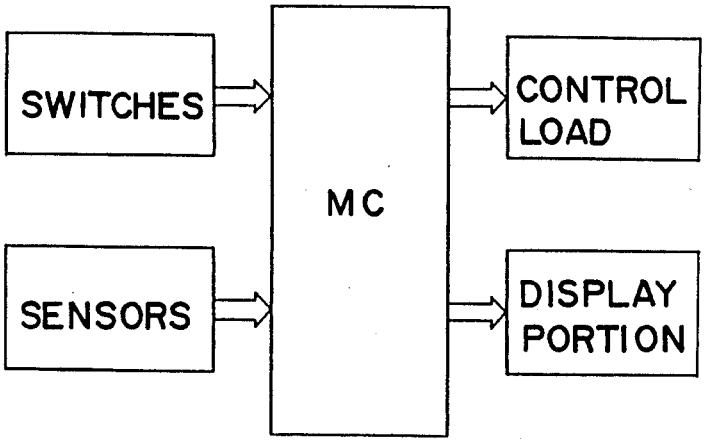
FIG. 3 is a control block diagram for the copying apparatus.

FIG. 3 is a control block diagram indicative of the control of the copying apparatus. In the block diagram of FIG. 3, a microcomputer MC receives signals sent from various operation switches and sensors, controls a load exerted upon an electric motor and the like on the basis of these signals, and displays requisite information on the display portion of the operation panel 40.

The operation switches include the aforementioned print switch 41, CLEAR-STOP key 42, UP and DOWN keys 44 and 45, density regulating lever 46, mode selecting key 47 and the like. The sensors include the aforementioned paper color detecting sensors 51 and 52, toner color detecting sensors 53 and 54 and the like.

Figure 4:
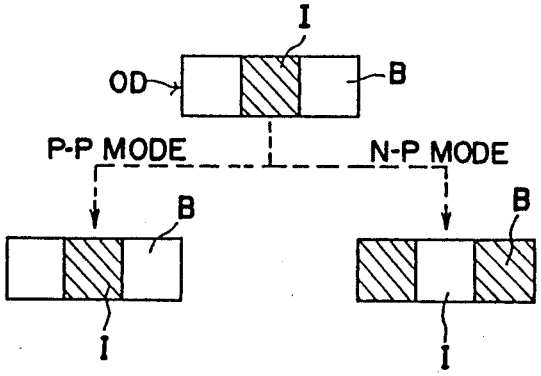
FIG. 4 is a view explanatory of a developing mode.

As shown in FIG. 4, the above described copying apparatus is capable of executing the following three copying modes alone or even in combination:

(i) the normal image producing mode (P-P mode) in which an original document (OD) having a white background portion (B) and a black image portion (I) is reproduced as it is;

(ii) the reversal image producing mode (N-P mode) in which the background portion and the image portion of said original document (OD) are reproduced in black and in white, respectively; and (iii) a composite copying mode (not shown) in which a plurality of images are reproduced one above another on one side of a single copy paper.

The selection between the normal and reversal image producing modes is carried out by the mode selecting key 47 whereas the composite copying mode is selected by a composite mode selecting key (not shown) provided on the operation panel 40.

The copying apparatus having the above described construction executes the copying operation as follows.

When the photosensitive drum 1 rotates in a direction shown by an arrow (a), a document platform 35 moves in a direction shown by an arrow (b) so that light from an exposure lamp 31 of the optical system 3 may be applied to an original document (not shown) placed on the document platform 35. The light reflected by the original document reaches, through an array of converging light transmitting members 32, the surface of the photosensitive drum 1 which has been charged to a certain level in potential by the main charger 2. In this way, an electrostatic latent image corresponding to an original image is formed on the photosensitive drum 1.

Upon rotation of the photosensitive drum 1, this electrostatic latent image reaches the developing devices 4 and 5 and is supplied with toner from either of them in accordance with the selected mode so that it may be turned into a visible toner image.

On the other hand, a copy paper is selectively supplied from either of the paper supply cassettes 20 and 26 upon rotation of the paper supply roller 21 or 27. The copy paper is then transported between the photosensitive drum 1 and the transfer charger 6 by the paired transport rollers 22 in synchronism with the toner image formed on the photosensitive drum 1 so that the toner image may be transferred onto the copy paper through the discharge of the transfer charger 6. Thereafter, the copy paper travels on and is guided by the guide plate 23 towards the fixing rollers 24 by which the toner image formed on the copy paper is fused and fixed before the copy paper is discharged onto the paper discharge tray 25.

Figure 10A:
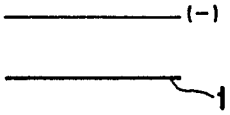
FIGS. 10*a* to 10*c* are schematic views explanatory of a copying process in a normal image producing mode.
Figure 10B:
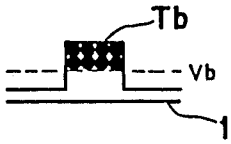
Figure 10C:
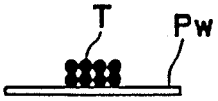

When the normal image producing mode is selected as the copying mode, the electrostatic latent image is turned into a visible image by black toner Tb supplied from the second developing device 5 and a black toner image is transferred onto a white paper Pw, as shown in FIGS. 10*a* to 10*c*. Letters Vb in FIG. 10*b* represent the developing bias voltage which is applied to the developing sleeves 4*a* and 5*a* and is the same in polarity as the surface of the photosensitive drum 1 charged by the main charger 2.

In contrast, when the reversal image producing mode is selected as the copying mode, either one of the following two processes is executed according to the case where black paper or papers are accommodated in the paper supply cassette 20 or 26 or the case where those are not.

Figure 11A:
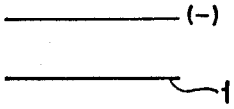
FIGS. 11*a* to 11*c* are schematic views explanatory of a copying process in a reversal image producing mode when a black paper is used.
Figure 11B:
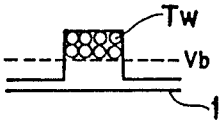
Figure 11C:
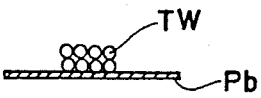

When the black papers are accommodated in the paper supply cassette 20 or 26, the electrostatic latent image is turned visible by white toner Tw supplied from the first developing device 4 and a white toner image is transferred onto a black paper Pb, as shown in FIGS. 11*a* to 11*c*.

On the other hand, when the paper supply cassettes 20 and 26 accommodate no black paper, two copying processes are repeatedly executed in a series of image forming operations, as shown in FIGS. 12*a* to 12*f*.

Figure 12A:
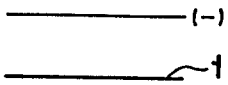
FIGS. 12*a* to 12*f* are schematic views explanatory of a copying process in a reversal image producing mode when a white paper is used.
Figure 12B:
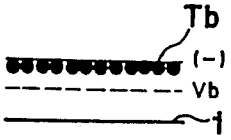
Figure 12C:
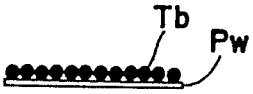

In the first copying process, the surface of the photosensitive drum 1 is initially uniformly charged by the main charger 2 (FIG. 12*a*). The black toner Tb is then supplied from the second developing device 5 to the charged portion of the drum surface (FIG. 12*b*). On this occasion, in the paper supply system, a white paper Pw is supplied from the paper supply cassette 20 or 26 so that a solid black toner image may be transferred onto one entire surface of the white paper Pw (FIG. 12*c*). In this way, the white paper Pw having the solid black image on its one entire surface is transported to the paper refeed device 28 by way of the fixing rollers 24. The surface of the photosensitive drum 1, onto which the black toner image has been transferred, then passes the cleaning device 8 and the eraser lamp 9.

Figure 12D:
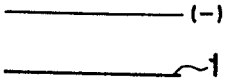
Figure 12E:
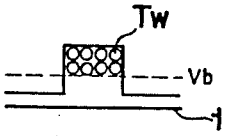
Figure 12F:
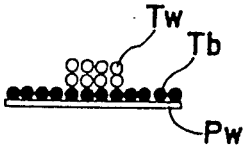

In the subsequent second copying process, the surface of the photosensitive drum 1 is again charged by the main charger 2 (FIG. 12*d*). The document platform 35 then moves in the direction of the arrow (b) and causes an original document placed thereon to be exposed to light emitted from the optical system 3 so that an electrostatic latent image corresponding to an original image may be formed on the surface of the photosensitive drum 1. This electrostatic latent image is turned into a visible white toner image by the first developing device 4 (FIG. 12*e*). The white toner image is then transferred onto the solid black toner image of the white paper Pw which has been transported by the paper refeed device 28 again to the location between the photosensitive drum 1 and the transfer charger 6 (FIG. 12*f*). In this way, a reversal image is formed on the surface of the photosensitive drum 1.

There are various kinds of known methods of selectively driving a plurality of developing devices.

In a certain method, on condition that a plurality of developing devices are movably supported with respect to the photosensitive drum, any desired developing device is selectively caused to approach the photosensitive drum.

In another method, a plurality of magnetic poles are so disposed within a developing sleeve as to be rotatable by a predetermined angle. In this method, one of the magnetic poles is caused to confront the photosensitive drum during the development. In contrast, a location between adjacent two magnetic poles is caused to confront the photosensitive drum, when the development is not executed.

In a further method, bias voltage applied to the developing sleeve is raised to a higher level when the development is not executed than during the development.

U.S. patent application Ser. No. 59,850 discloses the above-mentioned methods in detail, and therefore, a further description will be omitted.

With reference to flow-charts of FIGS. 5 to 9, the way how the copying apparatus is controlled will be explained hereinafter.

Figure 5:
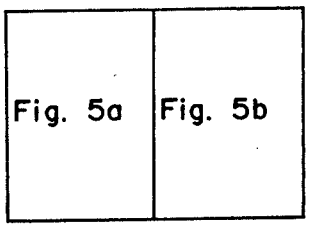
FIG. 5 is a flow-chart indicative of the main routine.
Figure 5A:
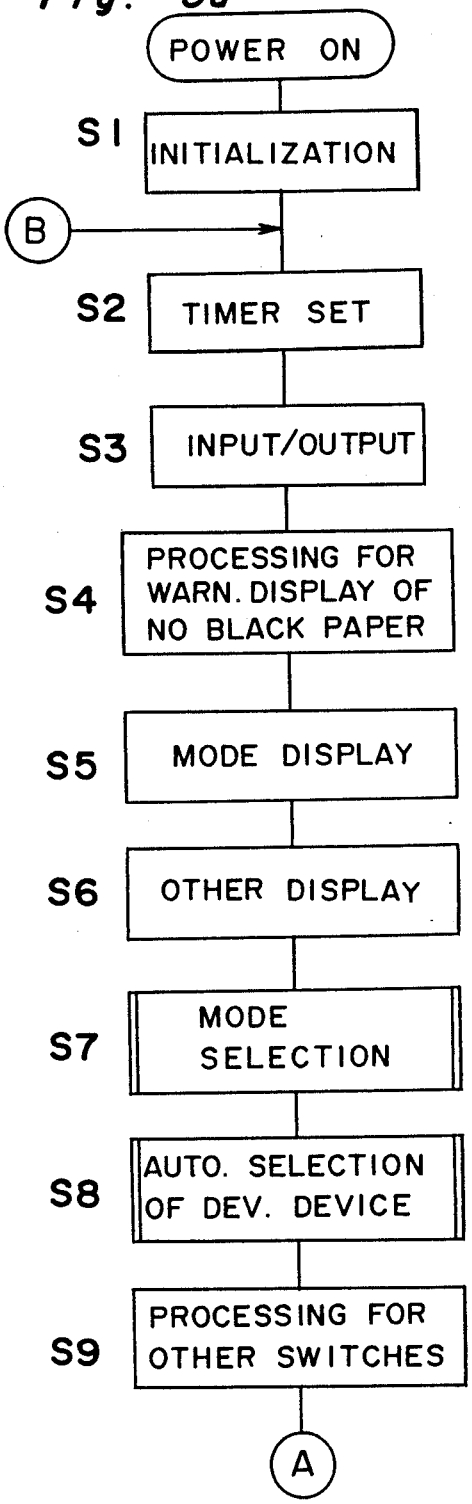
Figure 5B:
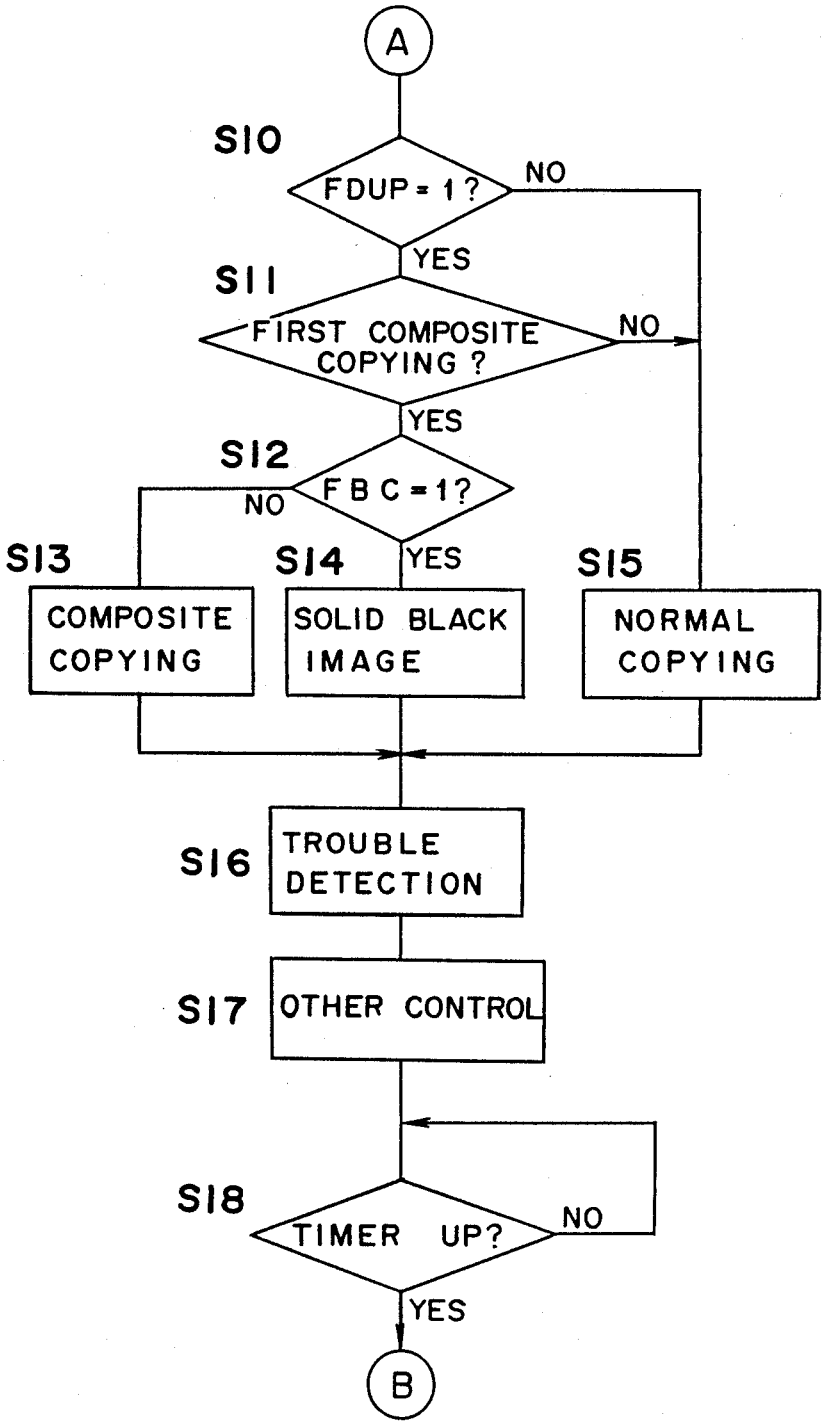

(i) Main Routine (FIG. 5)

When the copying apparatus is turned on, the microcomputer MC is initialized at step s1. For example, the number of copies is set to "1".

At the subsequent step s2, an internal timer is set to control the period of time required for one routine of each of various processes which will be in detail described below.

At the steps S3 to S9 are executed the following respective subroutines: an input and output processing subroutine; a subroutine for processing warning display indicative of the absence of black paper; that for processing mode display of the N-P and P-P modes; that for processing other display; that for processing the mode selecting switch; that for processing automatic selection of the developing devices; and that for processing other operation switches.

The input and output processing subroutine is a routine for receiving signals inputted by various switches and sensors provided on the operation panel 40 and for outputting signals required for control load or various display portions. In the subroutine for processing warning display indicative of the absence of black paper, it is judged whether or not a black paper or papers are accommodated in the paper supply cassettes 20 and 26 on the basis of signals from the black paper detecting sensors 51 and 52. If no black paper is accommodated in the paper supply cassette 20 or 26, this routine informs of this fact.

The mode display processing subroutine is provided for displaying the copying mode to which the copying apparatus is set at present. In the subroutine for processing automatic selection of the developing devices, the developing device to be used is selected in accordance with the designated copying mode.

The subroutine for processing other operation switches executes the processing of signals inputted by various operation switches, the print switch 41 and the like.

It is judged at step s10 whether or not an FDUP flag is "1". The FDUP flag is a flag for displaying the composite copying mode in which a plurality of images are formed one upon another on one surface of a copy paper. When the composite copying mode is selected, the FDUP flag is set to "1". Accordingly, the selection of the composite copying mode renders the procedure to proceed to step s11 at which it is judged whether or not the copying operation which is now being carried out is the first one in the composite copying operation. If the first copying operation is being carried out, the procedure proceeds to step s12. In contrast, when the composite copying mode is not selected or when the second copying operation is being carried out in the composite copying mode, the procedure proceeds to step s15 at which the normal copying operation is carried out so that an image corresponding to the original image may be formed on the copy paper by the black or white toner.

At step s12 is judged whether or not an FBC flag is "1". The FBC flag is a flag indicative of the reversal image producing mode as shown in FIGS. 12*a* to 12*f*, in which a white toner image is overlapped on a solid black image formed on one entire surface of a white paper. If the FBC flag is "1" at step s12, only the second developing device 5 is driven at step s14 so that the black toner may be supplied on one entire surface of the paper to form the solid black image. In contrast, if the FBC flag is "0", the normal composite copying operation is carried out at step s13 so that the desired original image may be reproduced on one surface of the white paper using the black toner.

Subsequently, any trouble such as, for example, paper jam or the like is detected at step s16 followed by step s17 at which other control processing is carried out. Thereafter, it is judged at step s18 whether or not the internal timer is up. If the internal timer is up, the procedure returns to step s2.

Among the aforementioned subroutines, the present invention particularly relates to the subroutine for processing warning display indicative of the absence of black paper, the mode display processing subroutine, the subroutine for processing the mode selecting switch, the subroutine for processing automatic selection of the developing devices, all of which will be explained hereinafter.

Figure 6:
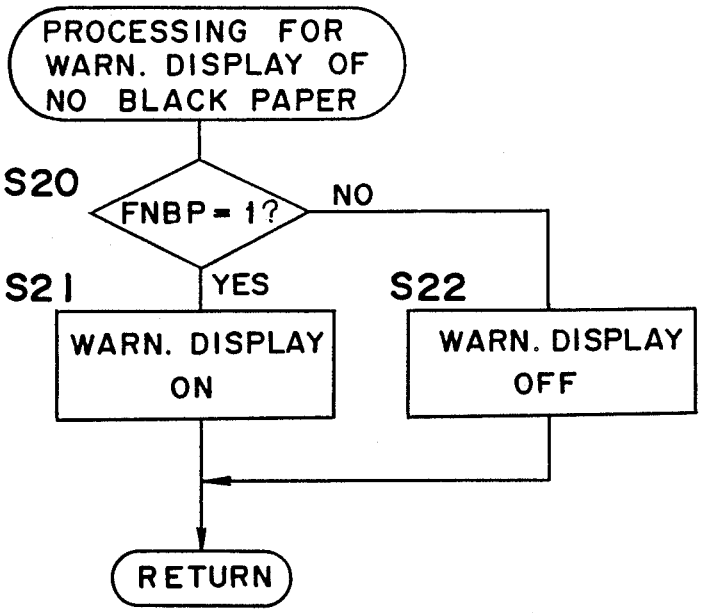
FIG. 6 is a flow-chart indicative of a subroutine for processing warning display of indicating the absence of black paper.

(ii) Subroutine for Processing Warning Display Indicative of The Absence of Black Paper A flow-chart of FIG. 6 shows this routine, in which, when the N-P mode has been selected, whether or not any black paper is set in the paper supply cassettes 20 and 26 is displayed on the operation panel 40.

It is initially judged at step s20 whether or not an FNBP flag is "1". The FNBP flag is a flag for informing the presence or absence of black paper when the N-P mode has been selected by the operation of the mode selecting key 47 provided on the operation panel 40. This flag is set to "1" when it has been judged on the basis of the signals sent from the sensors 51 and 52 that no black paper is charged in the cassettes 20 and 26 in the N-P mode.

When the FNBP flag is "1", the LED 50 is turned on at step s21 to inform of the absence of black paper in the cassettes. On the contrary, when the black paper or papers are charged in the cassette 20 or 26 and the FNBP flag is "0", the LED is turned off at step s22, and thereafter, the procedure returns to the main routine.

(iii) Mode Display Processing Subroutine

Figure 7:
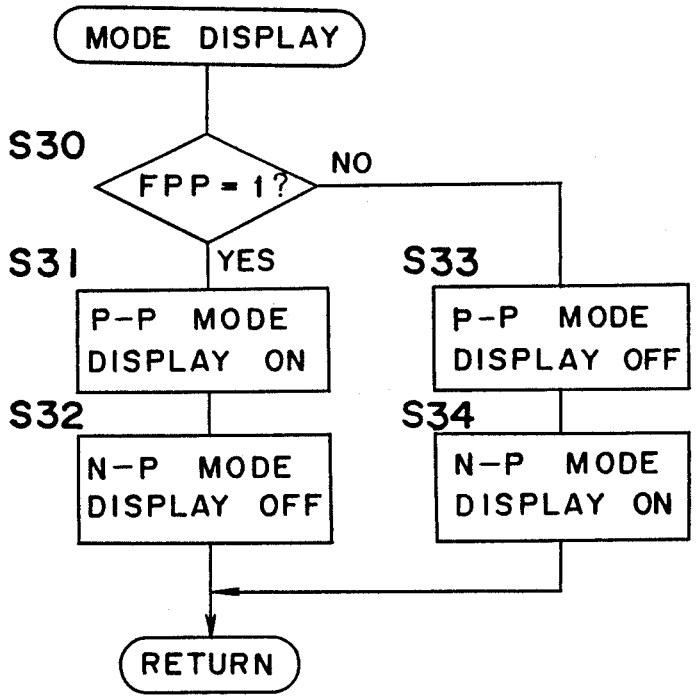
FIG. 7 is a flow-chart indicative of a mode display processing routine.

In this routine, either one of the P-P and N-P modes selected by the mode selecting key 47 is displayed on the operation panel 40, as shown in a flow-chart of FIG. 7. It is judged at step s30 whether or not an FPP flag is "1". The FPP flag is a flag for judging which mode has been selected. When the P-P mode has been selected, this flag is set to "1", whereas when the N-P mode has been selected, this flag is set to "0".

Accordingly, when the selected mode is the P-P one, the LED 48 is turned on at step s31 to display that the P-P mode has been selected, followed by step s32 at which the LED 49 indicative of the N-P mode is turned off.

On the contrary, when the selected mode is the N-P one, the procedure proceeds to step s33 at which the LED 48 indicative of the P-P mode is turned off. At subsequent step s34, the LED 49 is turned on to display that the N-P mode has been selected.

(iv) Subroutine for Processing Mode Selecting Switch

Figure 8:
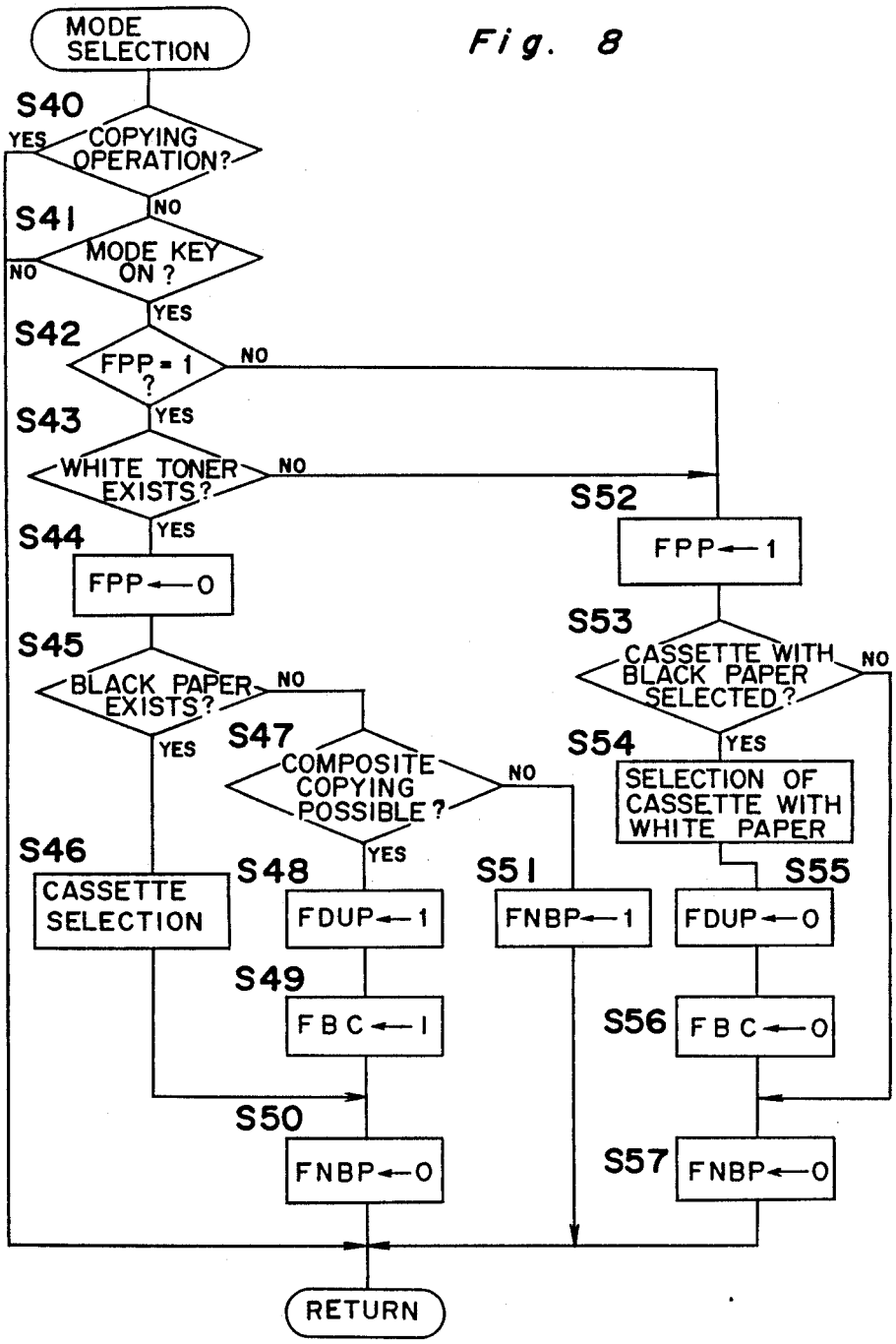
FIG. 8 a flow-chart indicative of a subroutine for processing a mode selecting switch.

A flow-chart of FIG. 8 shows this routine, in which the control for selecting copy papers to be supplied is carried out when the P-P or N-P mode has been selected by the mode selecting key 47.

It is initially judged at step s40 whether or not the copying operation is being carried out. If the judgment at step s40 is NO, it is judged at step s41 whether or not the mode selecting key 47 for switching the copying mode has been depressed i.e., whether or not the OFF condition of this key 47 has been changed to the ON condition thereof.

When the copying operation is not being carried out and the mode selecting key 47 is turned on, the procedure proceeds to step s42. Otherwise, the procedure returns to the main routine. At step s42, it is judged whether the P-P or N-P mode has been selected prior to the depression of the mode selecting key 47. When the FPP mode is "1" i.e., the N-P mode has been selected, the procedure proceeds to step s43, whereas when the FPP mode is "0" i.e., the P-P mode has been selected, the procedure proceeds to step s52.

It is judged at step s43 on the basis of the signals from the toner color detecting sensors 53 and 54 whether or not the white toner is accommodated in at least one of the developing devices 4 and 5. If the white toner is accommodated in the developing device 4 or 5, the FPP flag is set to "0" at step s44 to permit the image producing operation in the N-P mode.

On the other hand, when it is judged at step s42 that the depression of the mode selecting key 47 at step s41 has selected the P-P mode or that none of the developing devices 4 and 5 accommodates the white toner in spite of the selection of the N-P mode, the FPP flag is set to "1" at step s52 to permit the image producing operation in the P-P mode.

When the copying operation in the N-P mode is permitted at step s44, it is judged at step s45 whether or not any black paper is accommodated in the paper supply cassette 20 or 26. When the black paper or papers are accommodated, the paper supply cassette 20 or 26 accommodating the black papers is selected at step s46. In this event, the FNBP flag which is associated with the display indicative of the absence of black paper is set to "0" at step s50, and then, the procedure returns to the main routine.

In short, in these steps, when the N-P mode has been selected, the paper supply system supplies the black paper, to which the white toner is supplied from the first developing device 4 to form the reversal image.

On the other hand, when it is judged at step s45 that no black paper is accommodated in the cassettes 20 and 26, it is judged at step s47 whether or not the copying apparatus can perform the composite copying operation. As the copying apparatus in this embodiment is provided with the paper refeed device 28, it can perform the composite copying. In the case of other copying apparatus which is not provided with such a function, the FNBP flag is set to "1" at step s51, and thereafter, the procedure returns to the main routine. As a result, the LED 50 is turned on to give warning for informing of the absence of black paper.

If the copying apparatus can perform the composite copying, the PDUP flag is set to "1" to select the composite copying mode at step s48 followed by step s49 at which the FBC flag is set to "1" to select the reversal image producing mode in which a solid black image is formed on one entire surface of the white paper. Thereafter, the FNBP flag is set to "0" at step s50 and the procedure returns to the main routine.

In short, when no black paper is accommodated in the paper supply cassettes 20 and 26 in the N-P mode on condition that the copying apparatus can perform the composite copying, the solid black image is formed on one surface of the white paper during the first copying process, followed by the second copying process in which the original image is overlapped on the solid black image using the white toner.

When the FPP flag is set to "1" at step s52 to permit the copying operation in the P-P mode, it is judged at step s53 whether or not the cassette accommodating the black paper or papers is now selected. If the judgment at step s53 is YES, the cassette to be used is switched to another cassette accommodating the white paper or papers at step s54 followed by step s55 at which the FDUP flag is set to "0" to release the composite copying mode. Furthermore, the FBC flag is set to "0" to release the reversal image producing mode at step s56 followed by step s57.

When it is judged at step s53 that the selected cassette is not the cassette accommodating the black papers but the cassette accommodating the white papers, the procedure skips to step s57 at which the FNBP flag is reset to "0" and the procedure returns to the main routine.

In other words, in the process at steps s52 to s57, when the P-P mode has been selected, the black toner image is formed on the white paper during the normal copying operation.

(v) Subroutine for Processing Automatic Selection of Developing Devices

Figure 9:
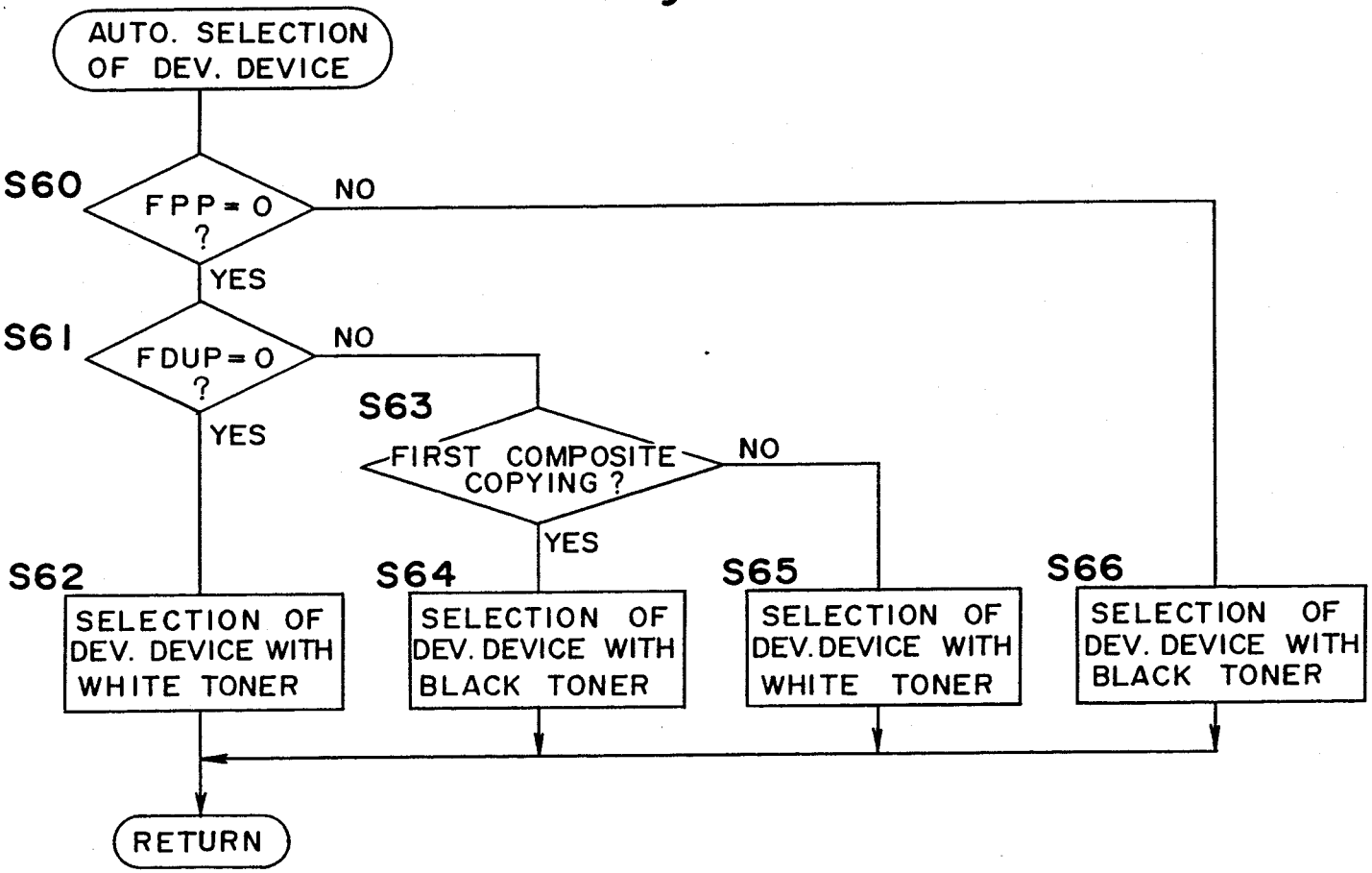
FIG. 9 is a flow-chart indicative of a subroutine for processing automatic selection of developing devices.

This routine is shown in a flow-chart of FIG. 9 and intended for selecting the desired developing device by switching two developing devices.

It is judged at step s60 whether or not the FPP flag is "0". If the FPP flag is "1" and the P-P mode has been selected, the developing device accommodating the black toner is selected at step s66 and is brought into a developing condition so that the black toner image may be formed on the white paper.

On the other hand, when it is judged at step s60 that the FPP flag is "0", it is judged at subsequent step s61 whether or not the FDUP flag is "0". When the FDUP flag is "0", the developing device accommodating the white toner is selected at step s62 so that the white toner image may be formed on the black paper. In contrast, when the FDUP flag is not "0" at step s61, it is judged at step s63 whether or not the present copying operation is the first one in the composite copying mode.

If the first composite copying operation is now being carried out, the developing device accommodating the black toner is selected at step s64 and the black toner is transferred onto one entire surface of the white paper. If the second composite copying operation is being carried out, the developing device accommodating the white toner is selected at step s65. The reversal image is then formed on the white paper in such a manner that the white toner image is overlapped on the solid black image which has been formed on the white paper during the first copying operation.

It is to be noted that in this embodiment, although the copying apparatus is equipped with the paper refeed device 28, not only the normal image but also the reversal one can be obtained by charging black papers into the paper supply cassette 20 or 26 even in a copying apparatus equipped with no paper refeed device.

As is clear from the above, the image forming apparatus of the present invention can produce both the normal image and the reversal one by making use of the white toner without the necessity of two sets of transfer chargers or electrifying chargers. Accordingly, the present invention extends the utility of white toner and can make more compact the image forming apparatus which is capable of producing both the normal image and the reversal one.

Moreover, since it is not necessary to switch the polarity of bias voltage applied to the developing sleeves of the developing devices, a small-sized power device is available.

As to toner to be used, as white toner and black toner have the same charging characteristic, any fog hardly takes place on an image to be produced, rendering the image to become clear.

In addition, the reversal image can be readily obtained by appropriately selecting the color of toner and that of copy paper.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. An image forming apparatus capable of producing both a normal image and a reversal image, said image forming apparatus comprising:

a photosensitive member;

a means for charging said photosensitive member;

a means for forming an electrostatic latent image on said photosensitive member;

a first developing means for developing the electrostatic latent image using a first toner;

a second developing means for developing the electrostatic latent image using a second toner which is different in color from the first toner;

a first paper supply means for supplying a first paper into a transfer region confronting said photosensitive member, said first paper being the same in color as the second toner;

a second paper supply means for supplying a second paper into the transfer region, said second paper being the same in color as the first toner;

a first control means for controlling said first developing means and said first paper supply means in order to form a first toner image on the first paper;

a second control means for controlling said second developing means and said second paper supply means in order to form a second toner image on the second paper; and a means for selecting either one of said first and second control means.

2. The image forming apparatus according to claim 1, wherein said first toner and said second toner are charged in the same polarity.

3. The image forming apparatus according to claim 1, wherein said second toner is white.

4. The image forming apparatus according to claim 3, wherein said first toner is black.

5. The image forming apparatus according to claim 1, wherein said first toner is black.

6. The image forming apparatus according to claim 1, further comprising a third control means for controlling said first developing means and said first paper supply means in order to obtain the second paper by forming a solid first toner image on the first paper.

7. The image forming apparatus according to claim 6, wherein said first toner and said second toner are charged in the same polarity.

8. The image forming apparatus according to claim 6, wherein said second toner is white.

9. The image forming apparatus according to claim 8, wherein said first toner is black.

10. The image forming apparatus according to claim 6, wherein said first toner is black.

11. An image forming apparatus capable of producing both a normal image and a reversal image, said image forming apparatus comprising: a photosensitive member;

a means for charging said photosensitive member;

a means for forming an electrostatic latent image corresponding to an original image on said photosensitive member;

a first developing means for developing the electrostatic latent image using a first toner;

a second developing means for developing the electrostatic latent image using a second toner which is different in color from the first toner;

a first paper supply means for supplying a first paper into a transfer region confronting said photosensitive member, said first paper being the same in color as the second toner;

a second paper supply means for supplying a second paper into the transfer region, said second paper being the same in color as the first toner;

a selecting means for selecting either one of a first image producing mode for producing a positive image from a positive original document and a second image producing mode for producing a positive image from a negative original document; and a controlling means for selecting said first developing means and said first paper supply means so that a first toner image may be formed on the first paper when the first image producing mode has been selected by said selecting means and for selecting said second developing means and said second paper supply means so that a second toner image may be formed on the second paper when the selecting means.

* * * * *